US007730654B2

(12) United States Patent
Kim

(10) Patent No.: US 7,730,654 B2
(45) Date of Patent: Jun. 8, 2010

(54) SYSTEMS AND METHODS FOR TRACKING AMMUNITION SUPPLY IN A MAGAZINE

(76) Inventor: Ray Kim, 35309 4th PL SW., Federal Way, WA (US) 98023

( * ) Notice: Subject to any disclaimer, the term of this patent is extended or adjusted under 35 U.S.C. 154(b) by 0 days.

(21) Appl. No.: 12/139,328

(22) Filed: Jun. 13, 2008

(65) Prior Publication Data

US 2009/0094875 A1 Apr. 16, 2009

Related U.S. Application Data

(60) Provisional application No. 60/943,796, filed on Jun. 13, 2007.

(51) Int. Cl.
*F41A 9/62* (2006.01)

(52) U.S. Cl. ..... 42/1.02

(58) Field of Classification Search ..... 42/1.01, 42/1.02, 1.05, 49.01, 50, 1.03, 7; 89/33.1
See application file for complete search history.

(56) References Cited

U.S. PATENT DOCUMENTS 1,252,094 A * 1/1918 De Lempdes ..... 42/106
2,828,568 A * 4/1958 Sakewitz ..... 42/50
4,587,756 A 5/1986 Jakubaschk et al.
5,206,444 A * 4/1993 Oliver ..... 42/1.02
5,291,679 A * 3/1994 Wollack et al. ..... 42/50
5,406,730 A * 4/1995 Sayre ..... 42/1.02
5,519,953 A * 5/1996 Villani ..... 42/1.02
5,642,581 A * 7/1997 Herold et al. ..... 42/1.02
5,768,817 A 6/1998 Simons
5,799,432 A * 9/1998 Wright et al. ..... 42/1.02
5,826,360 A * 10/1998 Herold et al. ..... 42/1.02
6,094,850 A * 8/2000 Villani ..... 42/1.02

* cited by examiner

*Primary Examiner*—Michael Carone
*Assistant Examiner*—Reginald Tillman, Jr.
(74) *Attorney, Agent, or Firm*—Christopher T L Douglas; Black Lowe & Graham

(57) ABSTRACT

Systems and methods for tracking ammunition supply in a magazine are disclosed herein. A method for tracking a number of cartridges remaining within a magazine includes tracking an indicator strip coupled to a spring housed within a magazine housing, the magazine housing having the spring coupled at a first end to a follower and at a second end to a foot plate, the spring tangent to the foot plate. The method further includes selectively altering a number of cartridges in the magazine housing and monitoring an indicator window attached to the foot plate and configured to guide the indicator strip, the indicator strip aligned with a reference on the indicator window showing the number of cartridges remaining.

20 Claims, 21 Drawing Sheets

SYSTEMS AND METHODS FOR TRACKING AMMUNITION SUPPLY IN A MAGAZINE

PRIORITY CLAIM

This application claims the benefit of U.S. Provisional Patent Application Ser. No. 60/943,796 as filed on Jun. 13, 2007; which is incorporated by reference herein.

BACKGROUND OF THE INVENTION

With the increasing complexity of small arms weapons systems and the increasing complexity of urban warfare, the importance of knowing the ammunition count within a weapon's ammunition magazine becomes more relevant. Death or serious bodily injury may result if an operator of a weapon with a magazine runs out of ammunition in the duration of a small arms altercation. Current magazines with full metal casings do not allow for a direct view into the ammunition storage inside a magazine, while plastic magazines allow a limited view at the ammunition source, but not beyond where the magazine goes into the weapon and is covered by the magazine well of the weapon. In many situations, knowing when a magazine is at its last five to ten rounds is more crucial than knowing when it has lost its first five to ten rounds, as usually indicated to a limited degree by most clear magazines, in the decision process for tactical magazine replacements.

Several strategies have been developed to aid the decision to change magazines in a weapon. One of the more popular is to add tracer ammunition at a predetermined count of ammunition. However, the disadvantage of this method is that in warfare, tracer ammunition can potentially create fires in buildings. Also, besides warning the operator of the weapon of the low ammunition count, tracers can likewise warn the operator's adversaries of the operator's position in the battlefield, which could be catastrophic for the operator. Furthermore, the use of tracer ammunition does not communicate the actual ammunition count to the operator, but just a warning of a low count of it.

Another method devised to aid with the magazine replacement decision process is keeping mental track of a magazine's remaining ammunition. By keeping a count, even if not with complete accuracy, an approximation of the count will provide enough information for the magazine change decision process. However, with the intensity and high stressfulness of small arms altercation situations, this becomes an impractical practice, as even an operator's momentary loss of focus could lead to the loss of count. Likewise, if the magazine that the operator is using does not contain the initial amount of ammunition that he or she believes it initially does, the basis for which the magazine replacement would occur will be faulty.

One of the more popular methods for deciding a magazine change is for an operator to estimate the amount of ammunition he or she has based on the weight of his or her weapon with ammunition. To a limited extent, this may be a useful approximation, however with the incorporation of different add-ons onto the operator's weapon, such as night sights, scopes and other accessories, the operator's judgment of the count can be hindered, increasing the liabilities associated with this method.

Understanding some of the limitations to the current systems and methods for keeping track of unspent ammunition, one embodiment of the present invention is devised to eliminate the risks caused from the overestimation of one's ammunition count, while avoiding the waste of ammunition caused by the premature replacement of magazines due to underestimation. By doing so, the aims of one embodiment of the present invention include, but are not limited to making the use of the ammunition within a given as efficient as possible with little compromise to the magazine's weight or profile, by aiding an operator in his or her decision process for changing magazines in high stress situations.

SUMMARY OF THE INVENTION

Systems and methods for tracking ammunition supply in a magazine are disclosed herein. A method for tracking a number of cartridges remaining within a magazine, includes tracking an indicator strip coupled to a spring housed within a magazine housing, the magazine housing having the spring coupled at a first end to a follower and at a second end to a foot plate, the spring tangent to the foot plate. The method further includes selectively altering a number of cartridges in the magazine housing and monitoring an indicator window attached to the foot plate and configured to guide the indicator strip, the indicator strip aligned with a reference on the indicator window showing the number of cartridges remaining.

A magazine configured for use in a firearm, the magazine including a floor plate; a follower configured to support a cartridge; a spring coupled and tangent to the floor plate and the follower to cradle a cartridge for use in a firearm; a round counter defining an aperture, coupled to the floor plate; and a material strip having a first end and a second end, the first end coupled to the spring and the second end inserted into the aperture defined by the round counter, the material strip aligning with a marker on the round counter representing the number of cartridges remaining.

BRIEF DESCRIPTION OF THE DRAWINGS

The preferred and alternative embodiments of the present invention are described in detail below with reference to the following drawings.

FIG. 5 is a drawing of another embodiment of the present invention which uses vibration as opposed to an number gauge as the means of alerting the operator of a low ammunition count within the ammunition magazine the present invention is attached to;

DETAILED DESCRIPTION OF THE PREFERRED EMBODIMENT

Figure 1A:
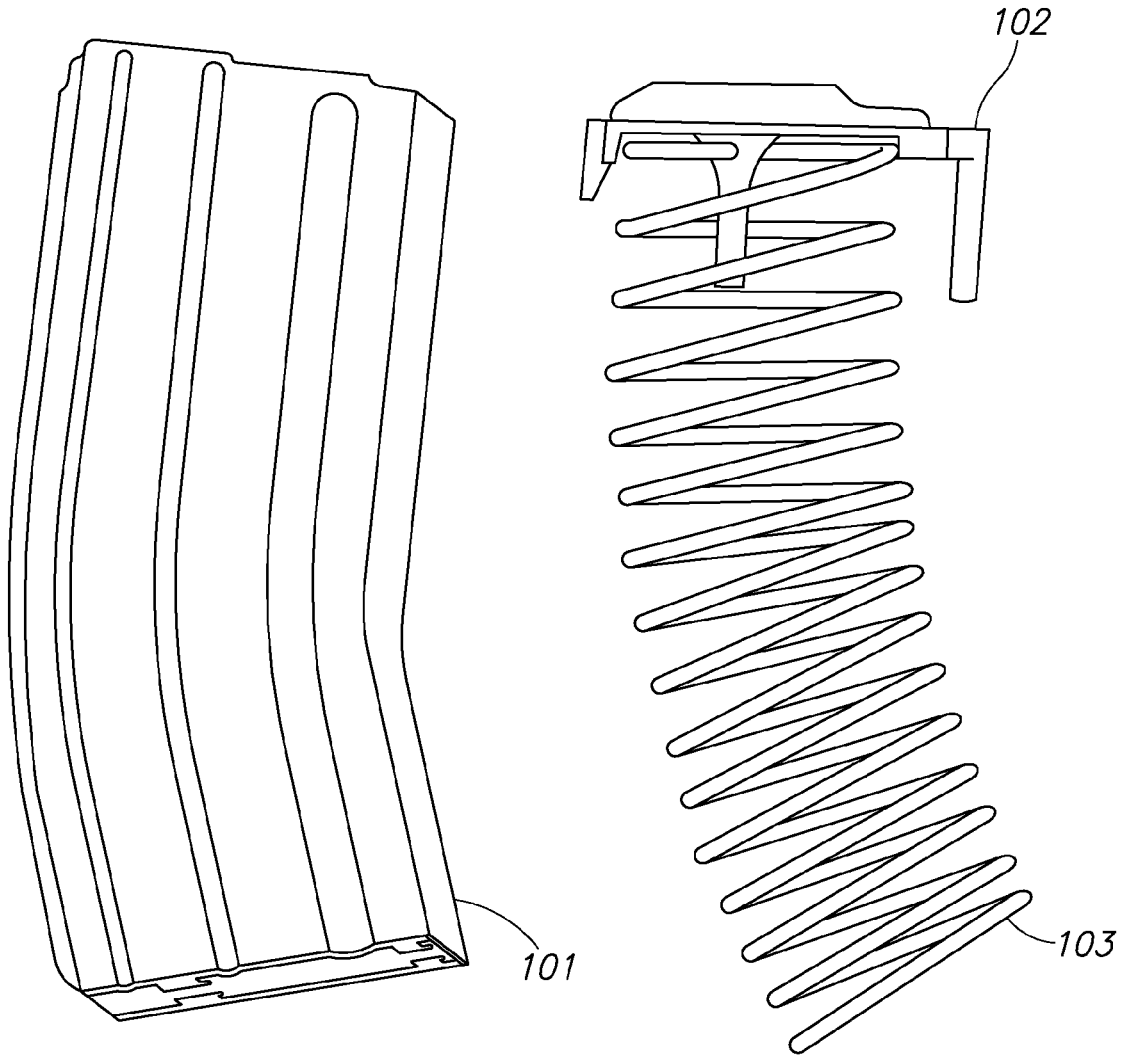
FIG. 1A is just one of the possible ammunition magazines to which all embodiments of the present invention may be attached.
Figure 1B:
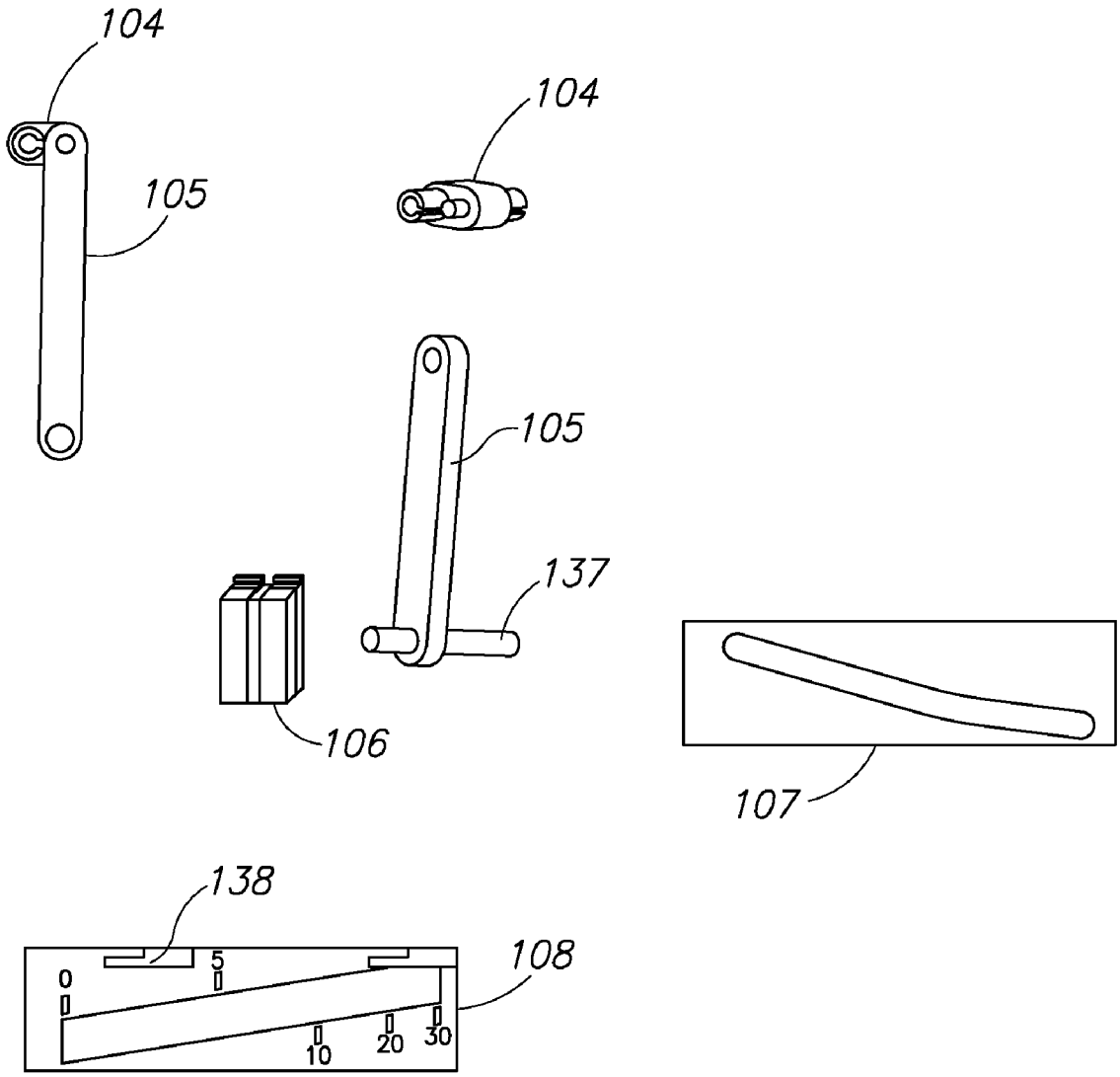
FIG. 1B is a breakdown of the present invention.
Figure 4:
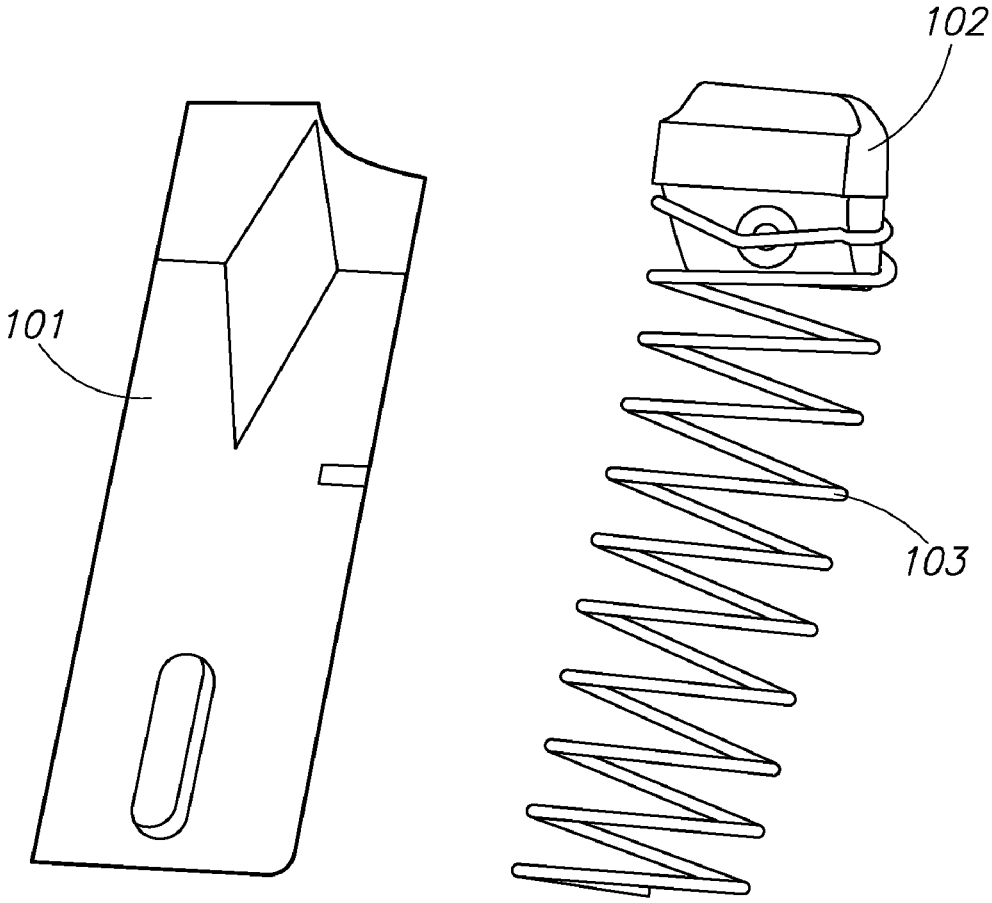
FIG. 4 is another ammunition magazine to which all embodiments of the present invention may be attached.

In reference to FIG. 1A and FIG. 4, an ammunition magazine is an apparatus which is used in conjunction with a firearm which dispenses ammunition into the firearm's firing chamber. Most magazines, as shown in, FIG. 1A, being composed of a protective casing 101, FIG. 4 dispense ammunition 109 by means of spring tension from a spring 103, 112 which raises a follower 102, 111 that brings up ammunition into an area of a firearm from which then can be stripped from the magazine top. When a magazine is first loaded, ammunition is horizontally placed within the magazine and pressed against a follower which in turn presses against a spring. The spring is compressed while loading and decompressed while extracting ammunition. The compression and decompression of the spring is used as means to determine an approximation for the count of ammunition within the magazine.

Figure 2:
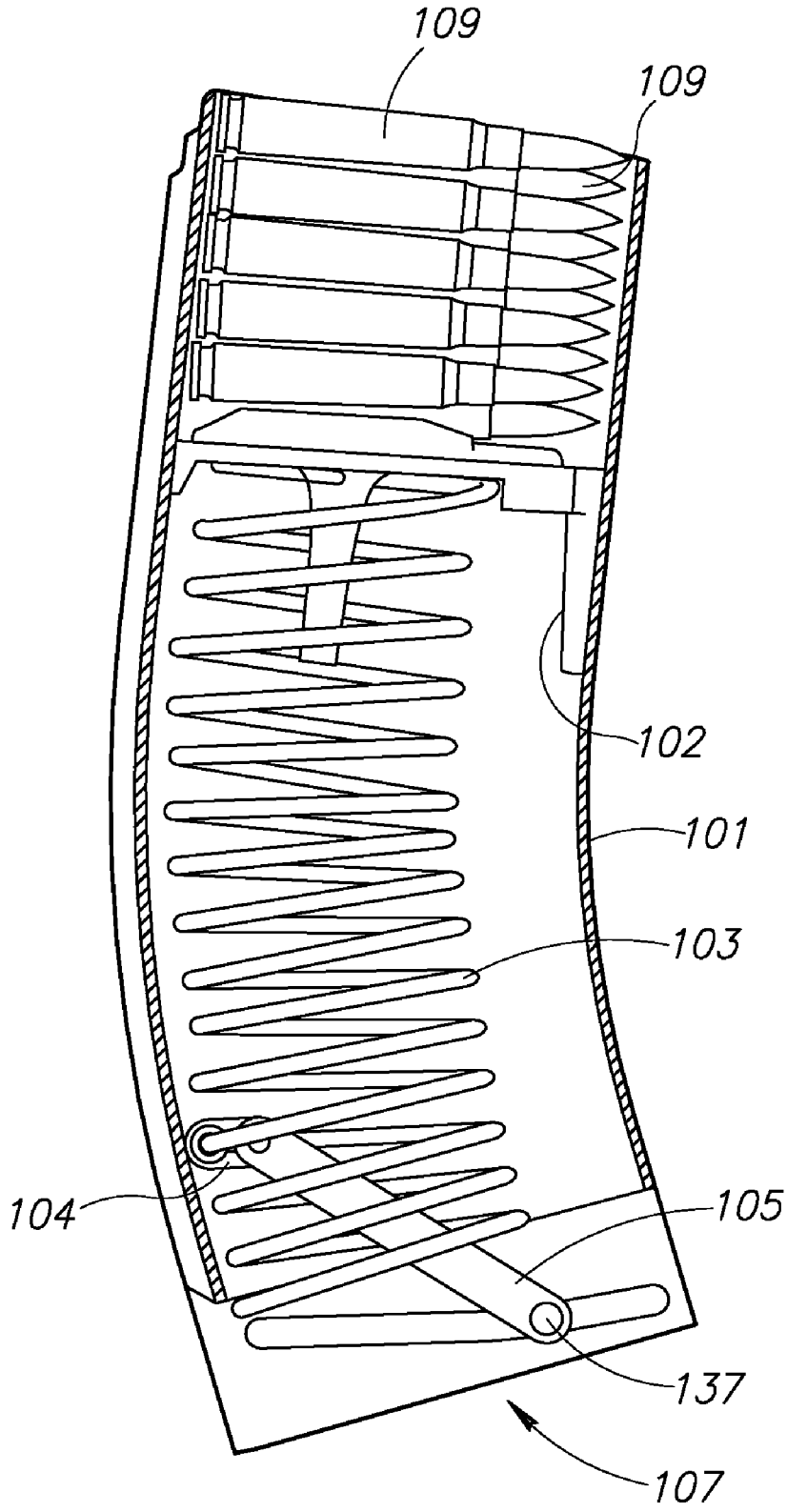
FIG. 2 is a side view in cross section of the ammunition magazine shown in FIG. 1A with the present invention from FIG. 1B attached.
Figure 3:
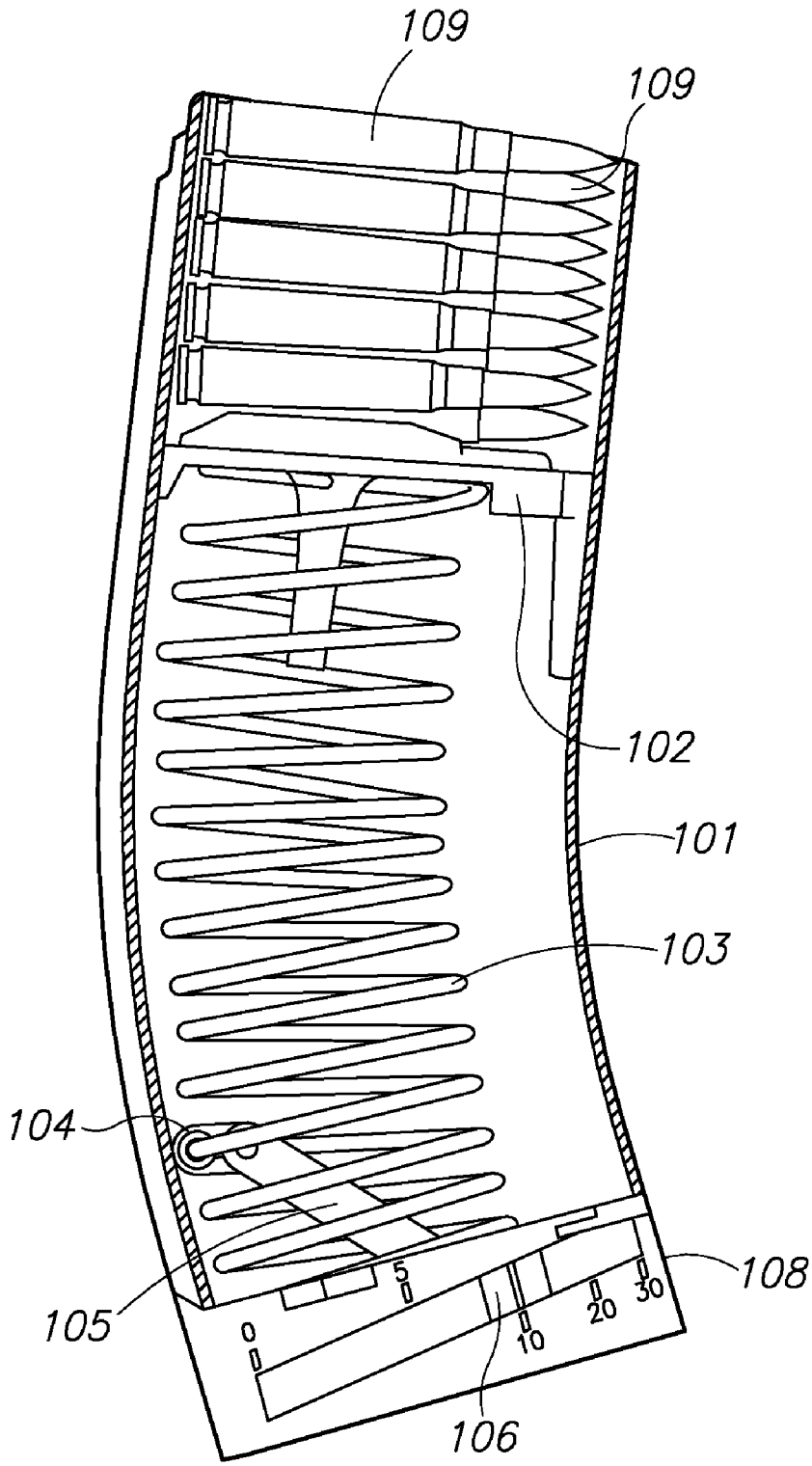
FIG. 3 is a similar side view in cross section as shown in FIG. 2, however the view of the present invention displays the counter gauge of the invention.

In reference to FIG. 2-3, the count of ammunition within the magazine is accomplished by the tilting movement of a rod piece 105 that is attached to a mount 104 that attaches to the fourth or fifth spine of the magazine spring. The lower half of the rod piece 105 has a horizontal rod 137 that goes into the grooves of a 107.

As the magazine spring compresses and decompresses, it does so at a consistent ratio which is coordinated to the number marks on the number gauge 108. The compression and decompression of the spring caused by the loading and unloading of ammunition into the magazine causes the mount 104 to move down or up respectively, causing the rod piece 105 to move rod 137 in the path dictated by the grooves of the side plate 107. This sideways movement forced by the grooves causes rod 137 to move the indicator strip piece 106 across the number gauge 108 at intervals dictated by the compression and decompression of the spring. The number of unspent ammunition within the magazine is coordinated to the number marks on the side of the number gauge 108.

The add-on variant of the main embodiment of the present invention may be attached to a pre-manufactured magazine by removing the magazine's floor plate and sliding in the hinges 138 of attachment to where the floor plate was attached to prior to its removal.

Figure 5:
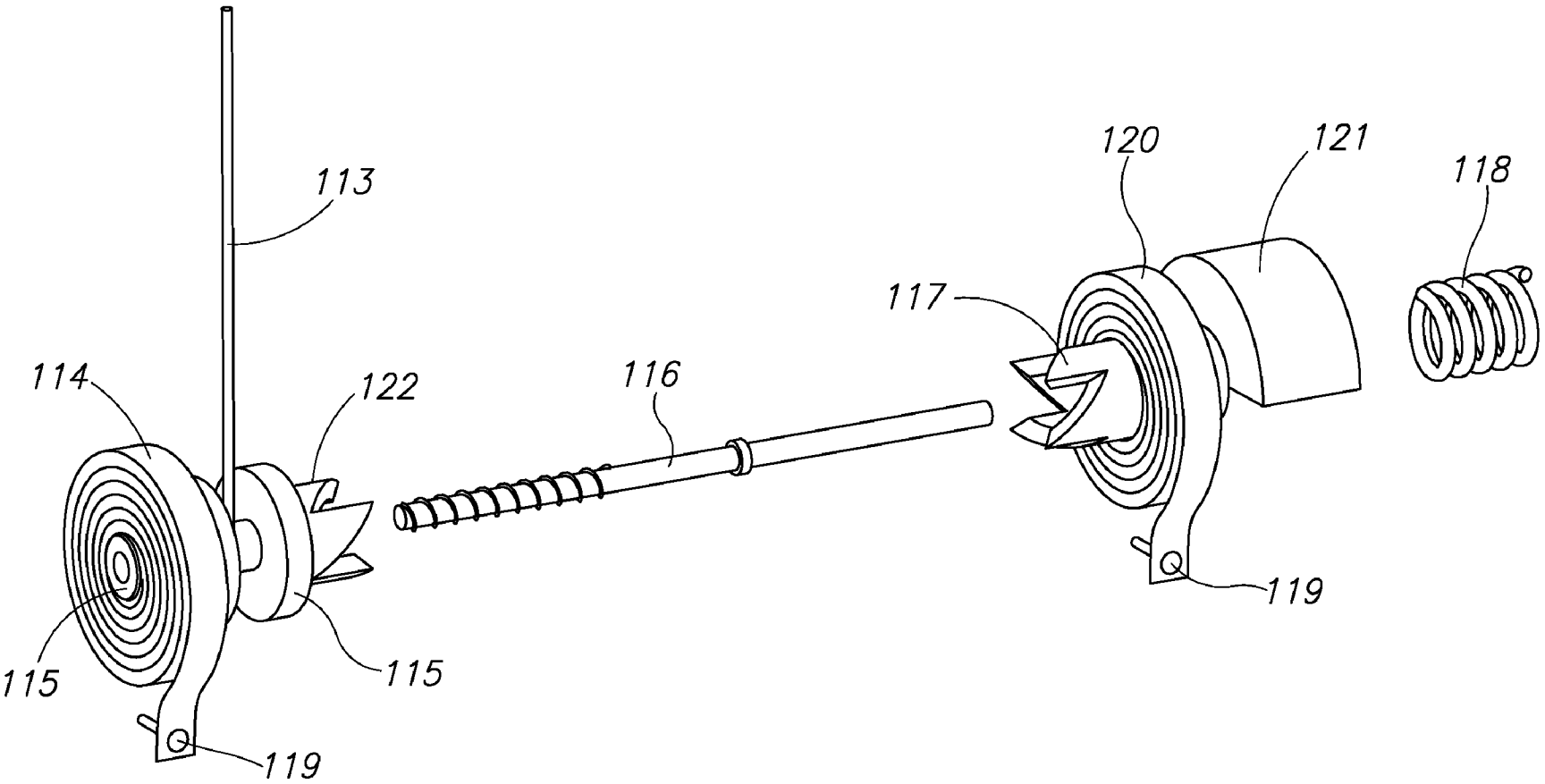
Figure 6:
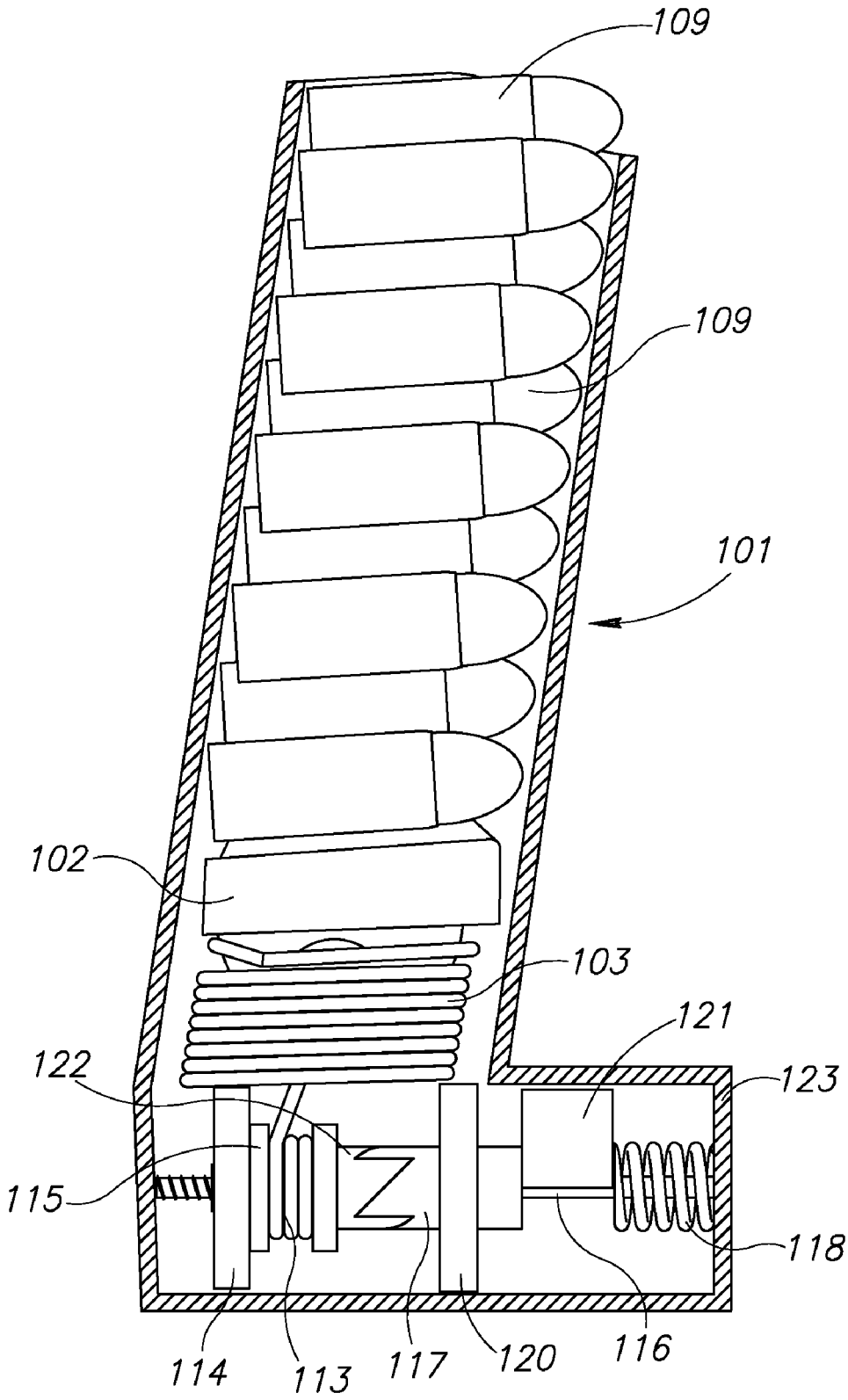
FIG. 6 is a side view in cross section of the ammunition magazine shown in FIG. 4 with the vibrating embodiment of the present invention shown in FIG. 5 at its inactivated state.
Figure 7:
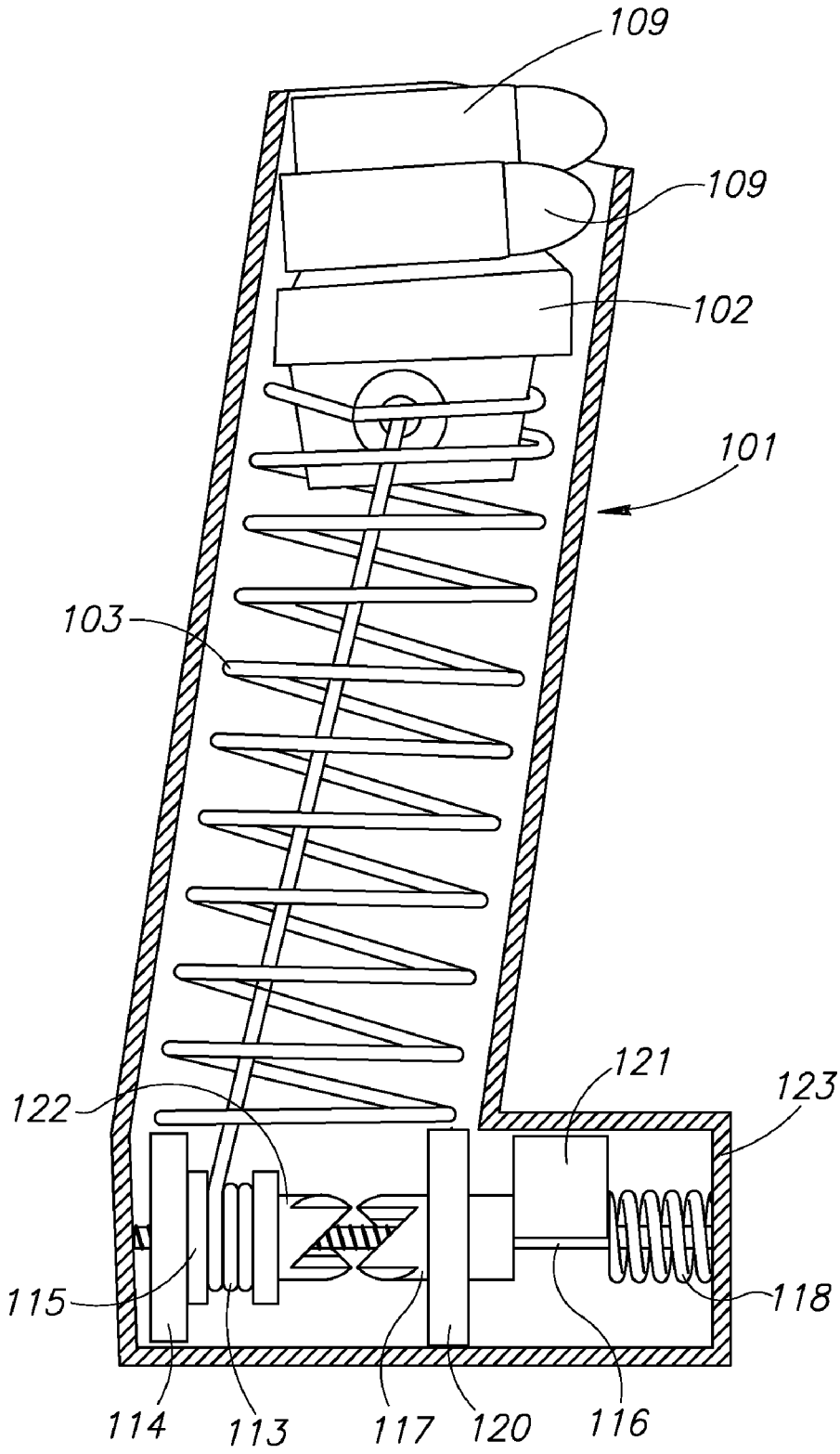
FIG. 7 is a similar side view in cross section as FIG. 6, but the alternative embodiment of the present invention is in its activated state which is triggered by the low count of ammunition within the ammunition magazine.

In reference to FIG. 5-7, an alternate embodiment uses the upward vertical movement of the follower 111 during unloading of ammunition from the magazine in order to activate a mechanical motor 121. Starting from a magazine at its fully loaded state, as ammunition is unloaded, a string 113 attached to the follower 111, through a loop in the follower or any other means, is pulled upwards, rotating a spindle 115 on which the string 113 is wrapped around. The rotation of the spindle 115 causes it to move rearward according to the directionality of the screw spirals on the rear half of rod 116. The rotation of the spindle 115 likewise compresses a spiral spring 114 which is mounted to the attachment casing 123 at its outer loose end with a nail 119. While rotating, the gear teeth 122 attached to the spindle 115 turn a second set of gear teeth 117 which are attached to a second spiral spring 120. This spiral spring 120 is similarly attached to the attachment casing 123 by a nail 119 at its outer loose end. Motor head 121 is likewise attached to the second spring 120 and second gear teeth 117 and is likewise turning while the magazine is being unloaded.

At a preset ammunition count that is considered by a manufacturer to be a low ammunition count, the two sets of gear teeth 117 and 122 will no longer be tangent due to the rearward movement of the spiral 114, spindle 115 and gear teeth 122 that are on the screw portion of the rod 116. This will cause spiral spring 120 to decompress because the force holding back the spring from unwinding has been lifted by the separation of the two gear teeth 122 and 117, causing the gear teeth 117 and motor head 121 attached to the spring 120 to rotate rapidly. The rapid rotating of the motor head 121 causes an uneven shift in weight throughout the attachment and the magazine, causing vibration.

When the magazine is reloaded, the string 113 attached to the magazine follower 111 will become slacked, allowing the rearward spiral spring 114 to decompress, causing the spring 114, spindle 115 and rearward gear teeth 122 to move forward on the screw portion of the rod 116. The rotating gear teeth 122 will rotate the still gear teeth 117, therefore working against the fully decompressed spring 120 that is attached to the motor head 121. Therefore, that spring 120 and gear head 121 will not rotate, but the still gear teeth 117 will move forwards on the rod 116 against a spring 118, forced by the rotating gear teeth 122 that will press against the still gear teeth 117 with the diagonal side of its teeth until the magazine is fully loaded or is empty.

Figure 8:
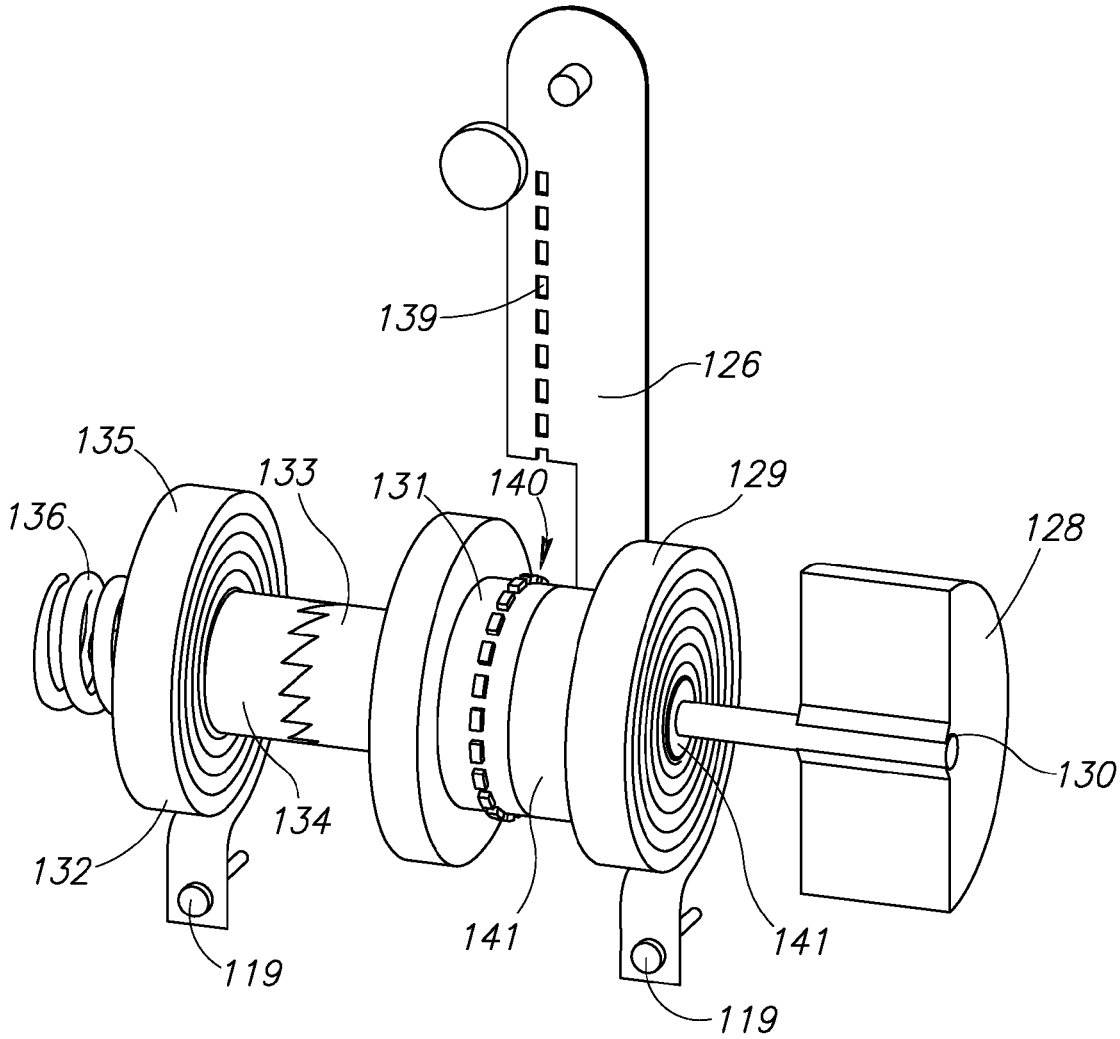
FIG. 8 is a drawing of the second vibrating embodiment of the present invention.
Figure 9:
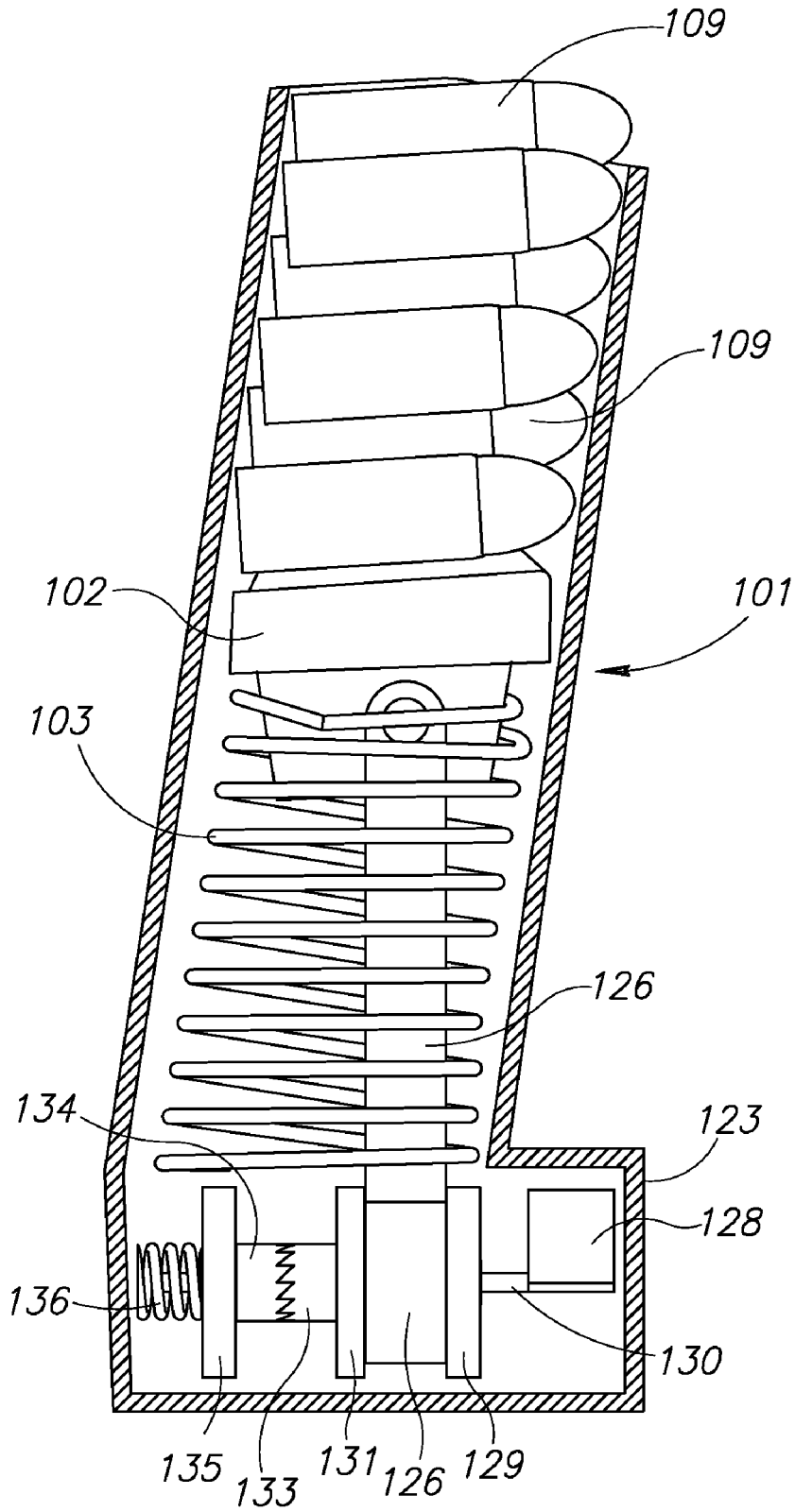
FIG. 9 is a side view in cross section of the ammunition magazine shown in FIG. 4 with the second vibrating embodiment of the present invention shown in FIG. 8 at its inactive state.
Figure 10:
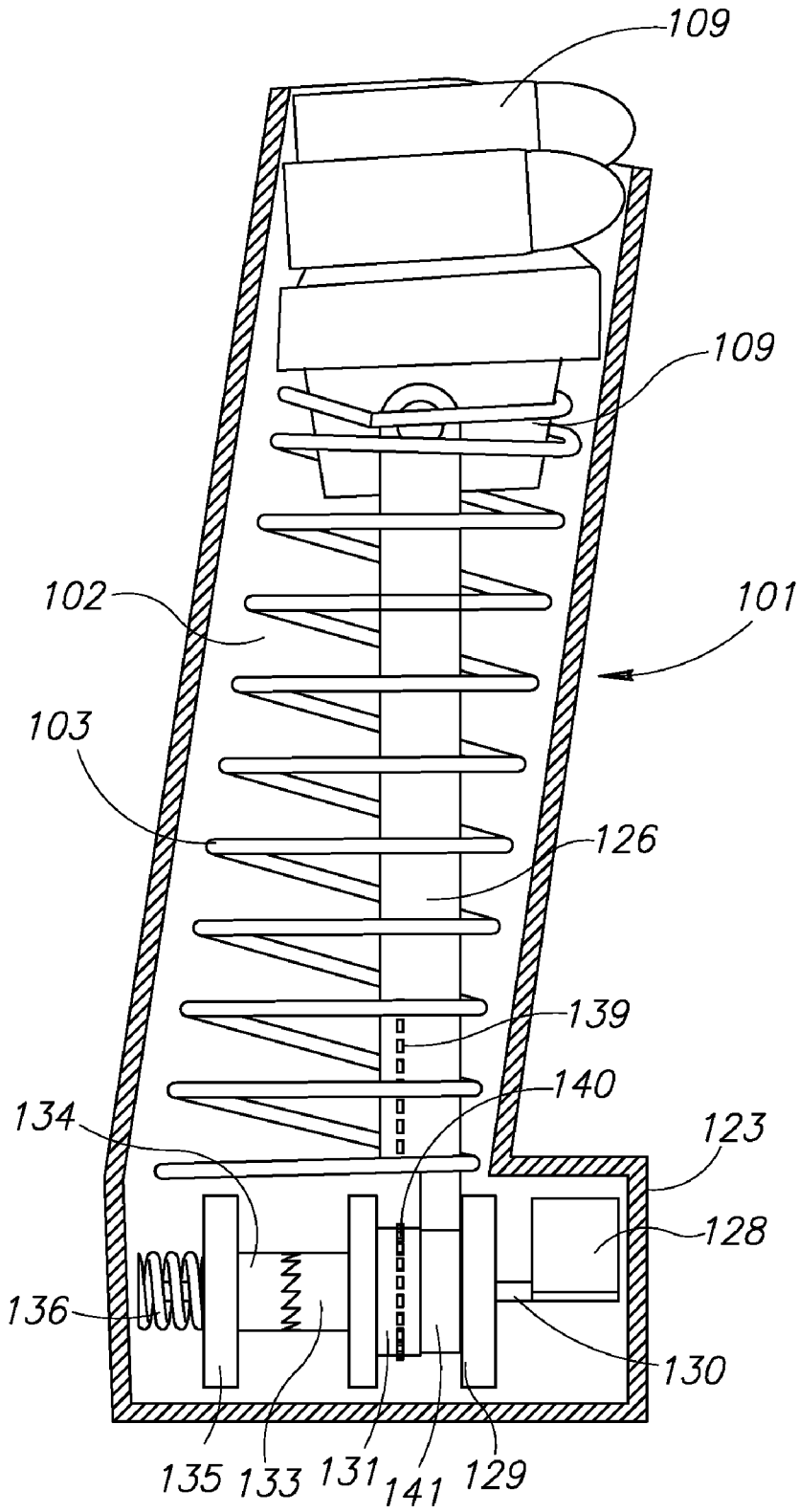
FIG. 10 is a similar side view in cross section as FIG. 9, however the alternative embodiment of the present invention is in its activated state, triggered by the low count of ammunition within the ammunition magazine.

In reference to FIG. 8-10, an alternate embodiment uses the upward movement of the magazine follower 111 by using a strip 126 attached to the magazine follower 111. The unloading of the magazine causes the strip 126 to rotate two spindles 131 and 141 which in turn compresses a spring forward of the magazine 129 and rotates gear teeth 134 through gear teeth 133, compressing another spring 135.

As shown in FIG. 10, the spindle 131 closer to the rear end of the magazine has little gear teeth 140 which hold on to the strip 126 by holding on to its perforated holes 139. When the ammunition count of the magazine is at its preset low count, again determined by the manufacturer, the little gear teeth 140 will let go of the perforated holes 139 on the strip 126, causing the rearward spiral spring 135 to decompress freely, spinning both sets of gear teeth 133 and 134, the spindle 131 and rod 130 to which the rearward spindle 131, forward gear teeth 133 and the motor head 128 are attached to. The uneven movement of the weight of the motor heard 128 causes vibration throughout the magazine attachment, magazine and weapon.

When the magazine is reloaded, the downward movement of the magazine follower will cause the strip 126 to become slackened, causing the forward spiral spring 129 to decompress, in turn matching up the perforated holes 139 on the strip 129 with the gear teeth 140 on the rearward spindle 131. The rearward spindle 31 will rotate causing the diagonal side of the gear teeth 133, 134 connected to the spindle 131 to force the rearward gear teeth 134 and rearward spiral spring 135 backwards against a spring 136 until the magazine is fully reloaded or reloading ceases.

The add-on variants of the alternate embodiments may be attached to a pre-manufactured magazine by removing the magazine's floor plate and sliding in the hinges 138 of attachment to where the floor plate was attached to prior to its removal. In an alternate embodiment the device may be built into a magazine.

Figure 11:
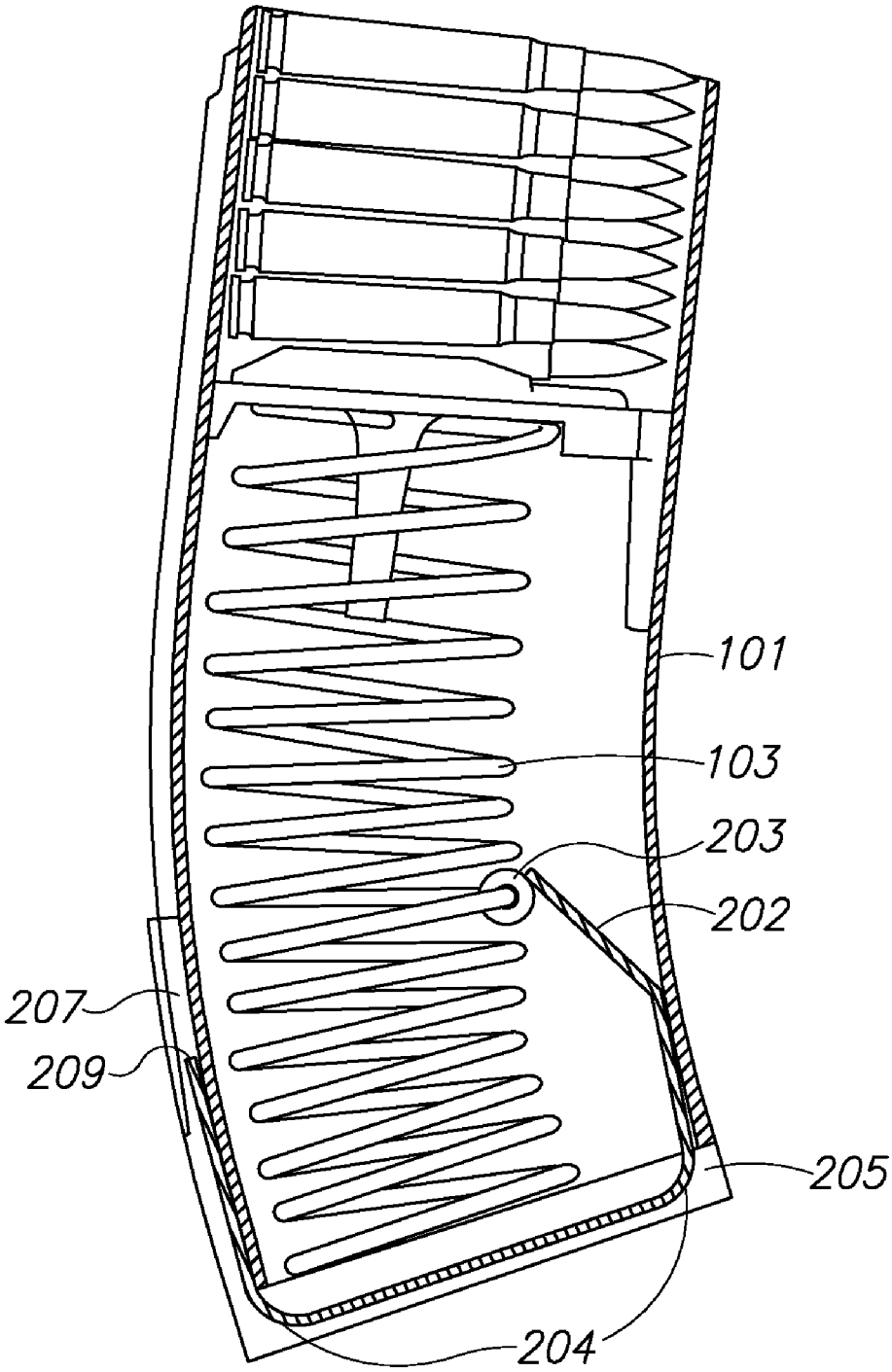
FIG. 11 is a side view in cross section of the ammunition magazine shown in FIG. 1A with the alternate embodiment of the present invention displayed in FIG. 13A and FIG. 13B attached.
Figure 12:
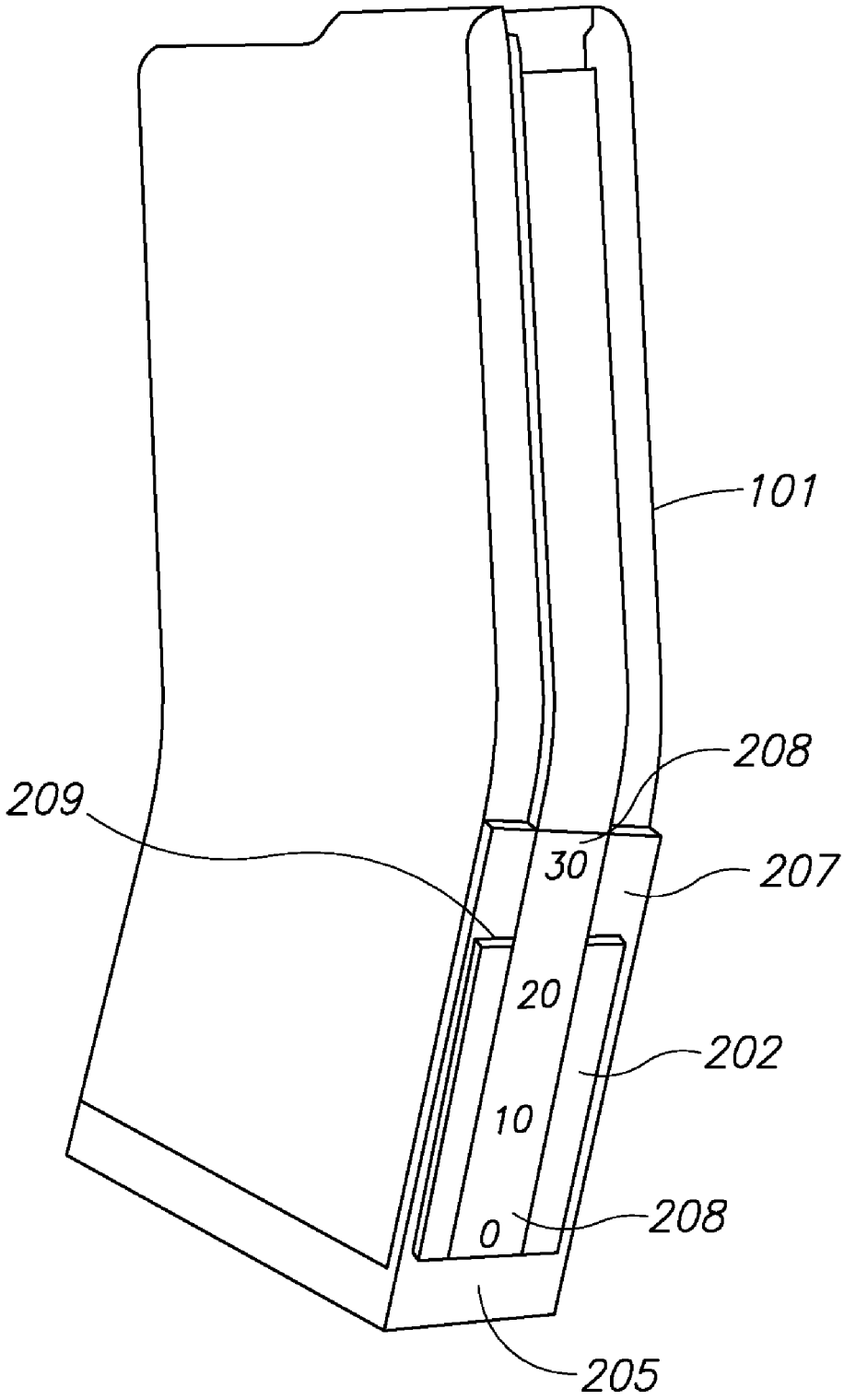
FIG. 12 is a rear diagonal view of FIG. 11 from which the display gauge is visible.
Figure 13A:
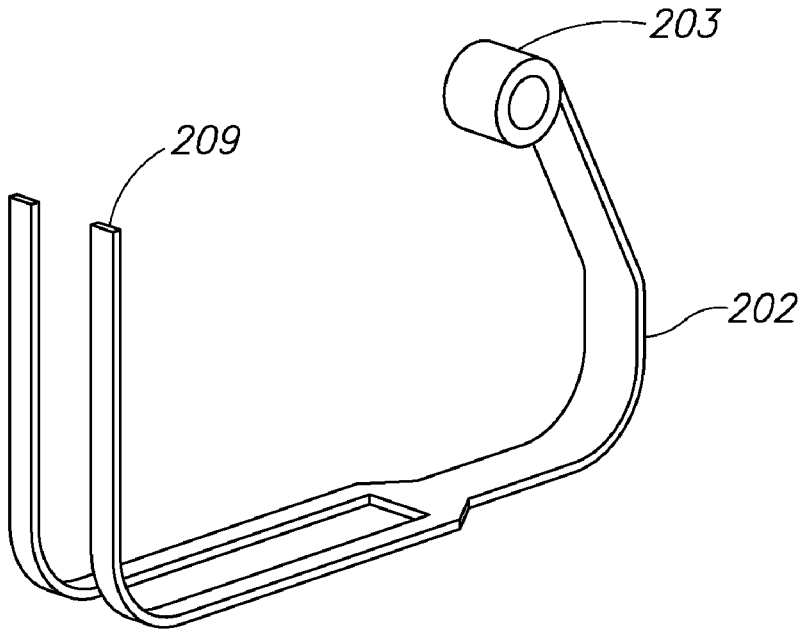
FIG. 13A is a drawing of the flexible strip indicator of another alternate embodiment of the present invention.
Figure 13B:
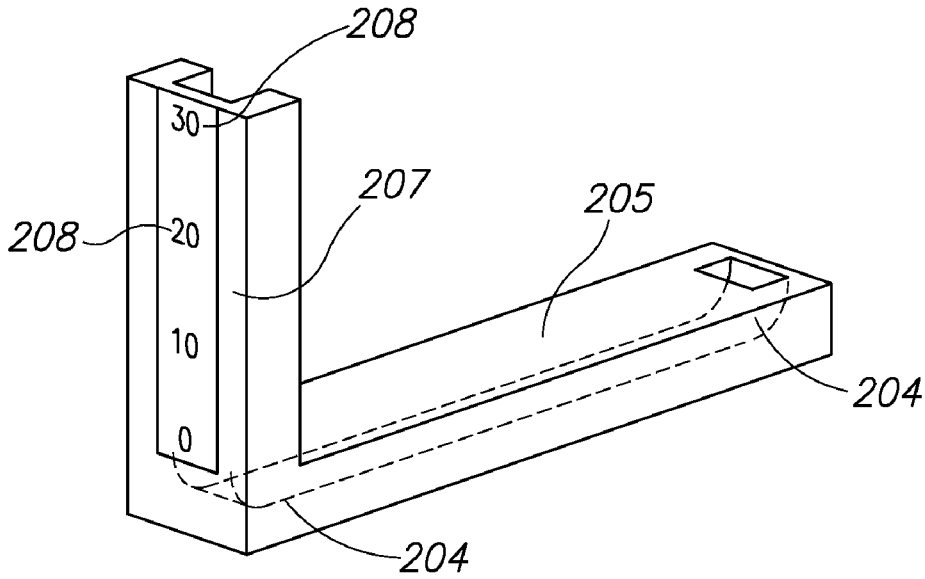
FIG. 13B is a drawing of the casing and display gauge of the embodiment displayed in FIG. 13A.
Figure 14A:
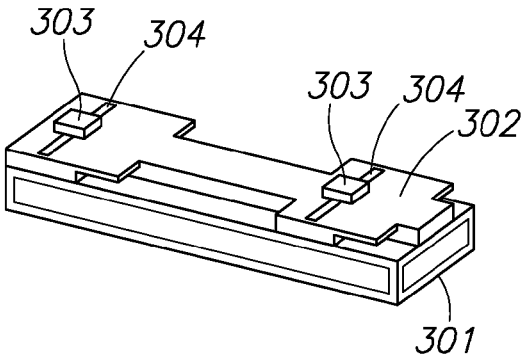
FIG. 14A is a drawing of the round counter slider embodiment in an un-retracted position.
Figure 14B:
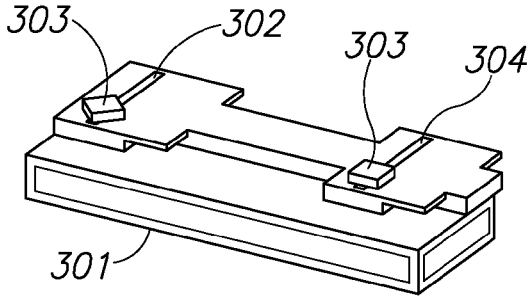
FIG. 14B is a drawing of the round counter slider embodiment in a retracted position.
Figure 14C:
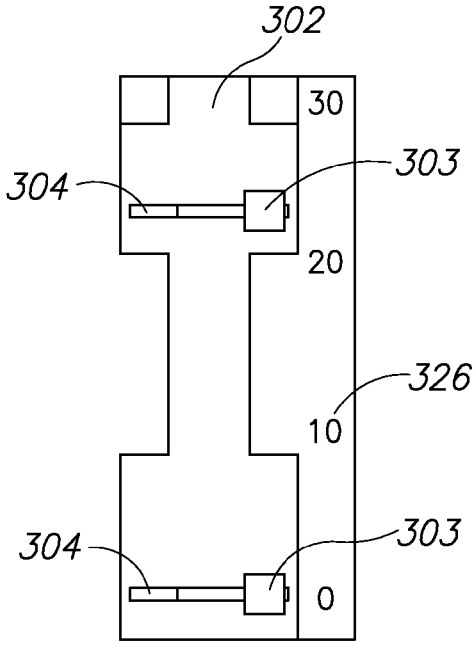
FIG. 14C is a top view of FIG. 14B with the display gauge visible.
Figure 14D:
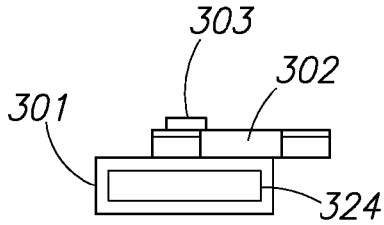
FIG. 14D is a front view of FIG. 14B.

FIGS. 11-13 show a strip reader in one embodiment. As the spring 201 of the magazine is depressed or compressed by the loading or unloading of ammunition into the magazine, its downward or upward motion is translated into a respective opposite motion by means of the flexible strip 202 which is attached to the spring 201 by a connector 203. The curvatures of the corners 204 found in a housing case 205, which is connected to the magazine case 206, facilitate the redirection of the strip's 202 movement 180 degrees. The strip's translated movement is displayed through a clear viewing window 207 where the position of its tip 209 may be used to reference the count of ammunition within the magazine by its flush position in relation to the number markings 208. The number markings 208 are set to correlate with the known and pre-measured level of ammunition that they are set to represent. The number markings 208 may likewise be color or patterns and not necessarily numbers.

Figure 15A:
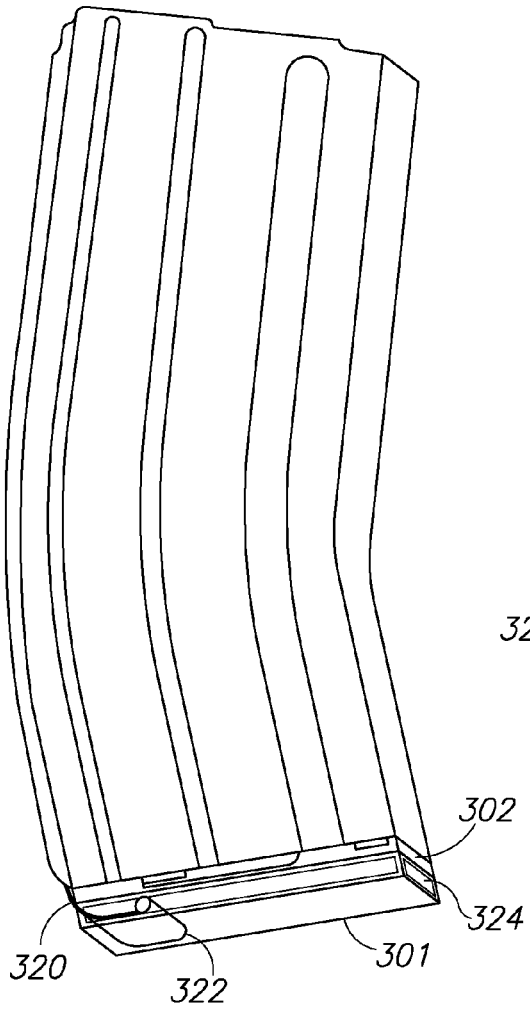
FIG. 15A is a side view in of the ammunition magazine shown in FIG. 1A with the round counter slider embodiment displayed in FIG. 14A attached.
Figure 15B:
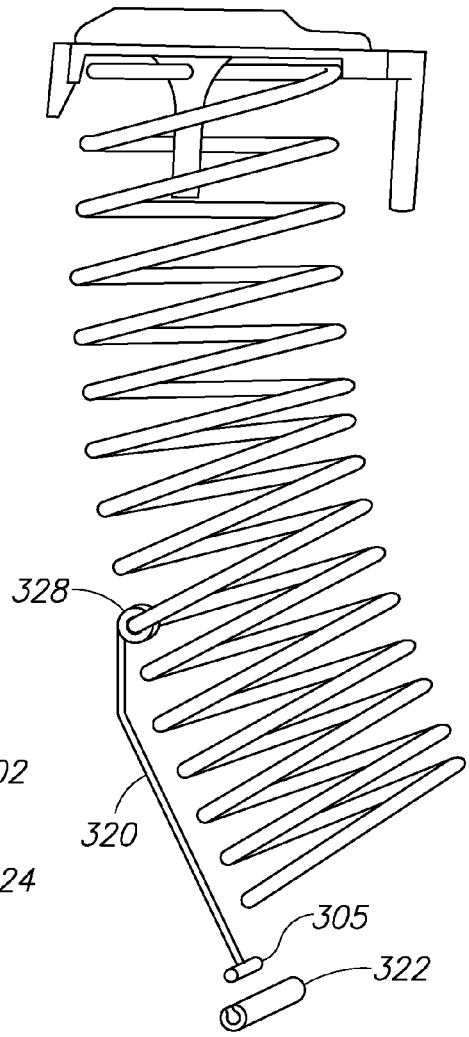
FIG. 15B is a breakdown of the round counter slider embodiment, less the casing and display gauge, attached to the magazine spring in FIG. 1A.
Figure 16:
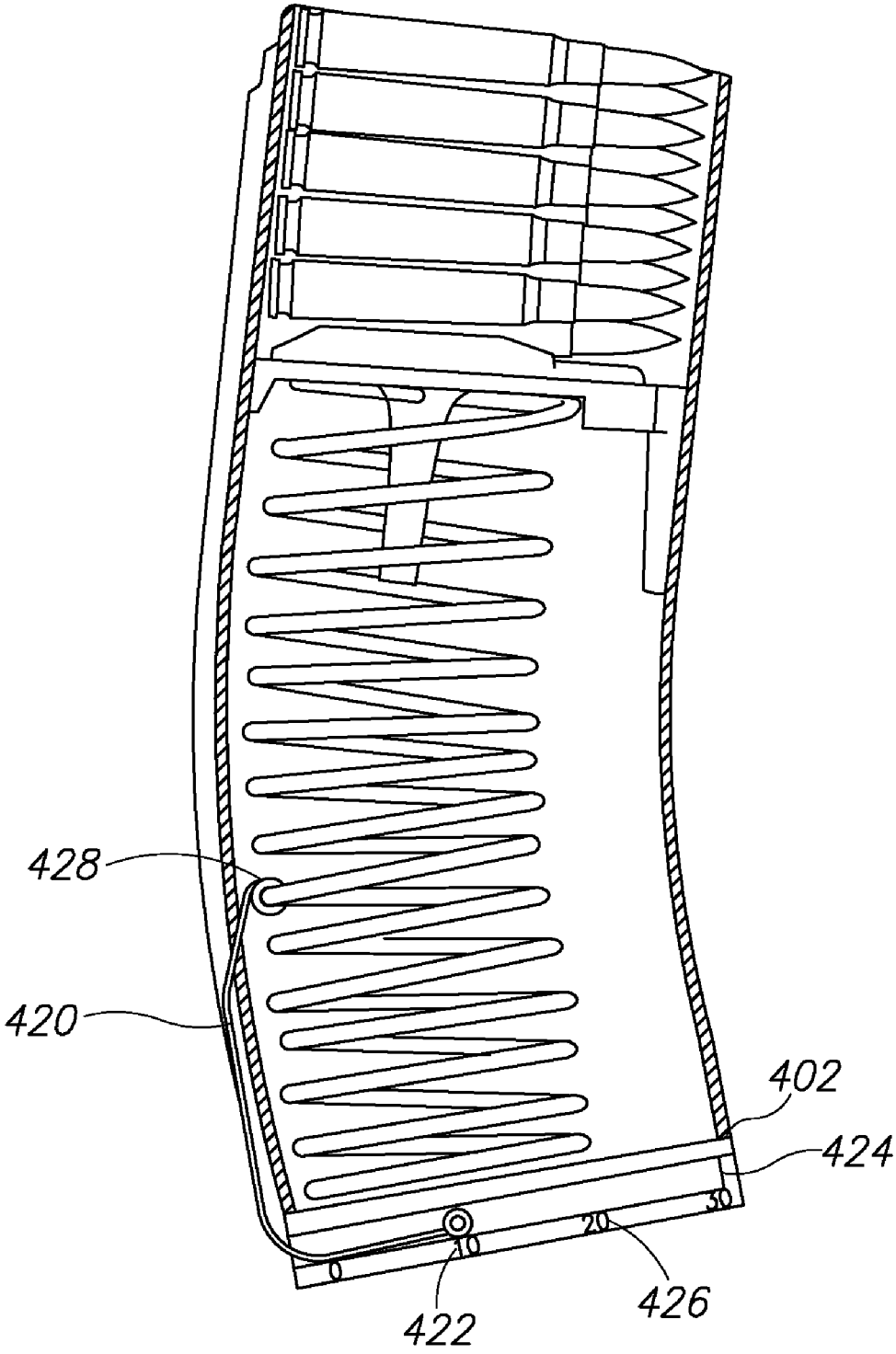
FIG. 16 is a side view in cross section of FIG. 15A.
Figure 17:
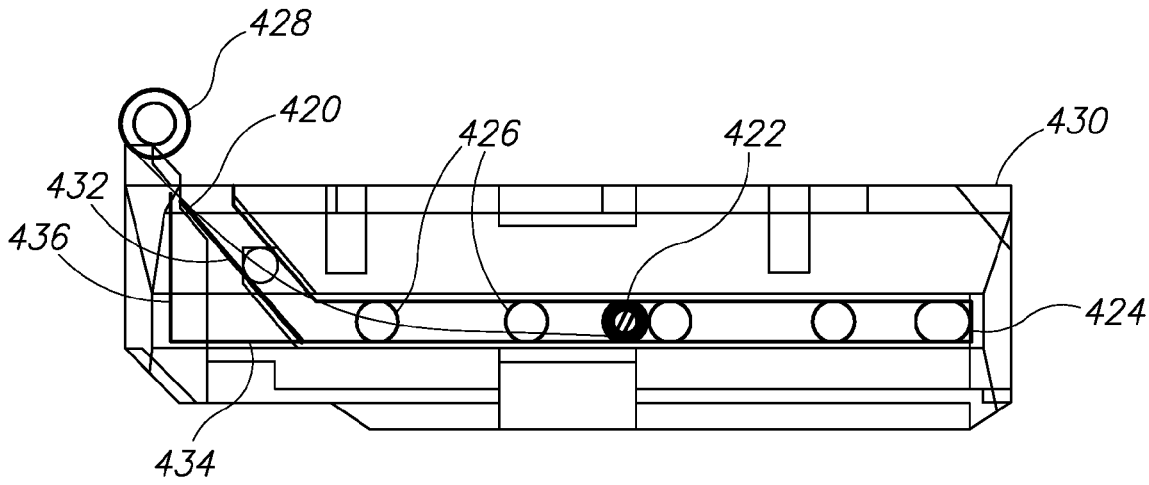
FIG. 17 is a side view in cross section of another embodiment.
Figure 18:
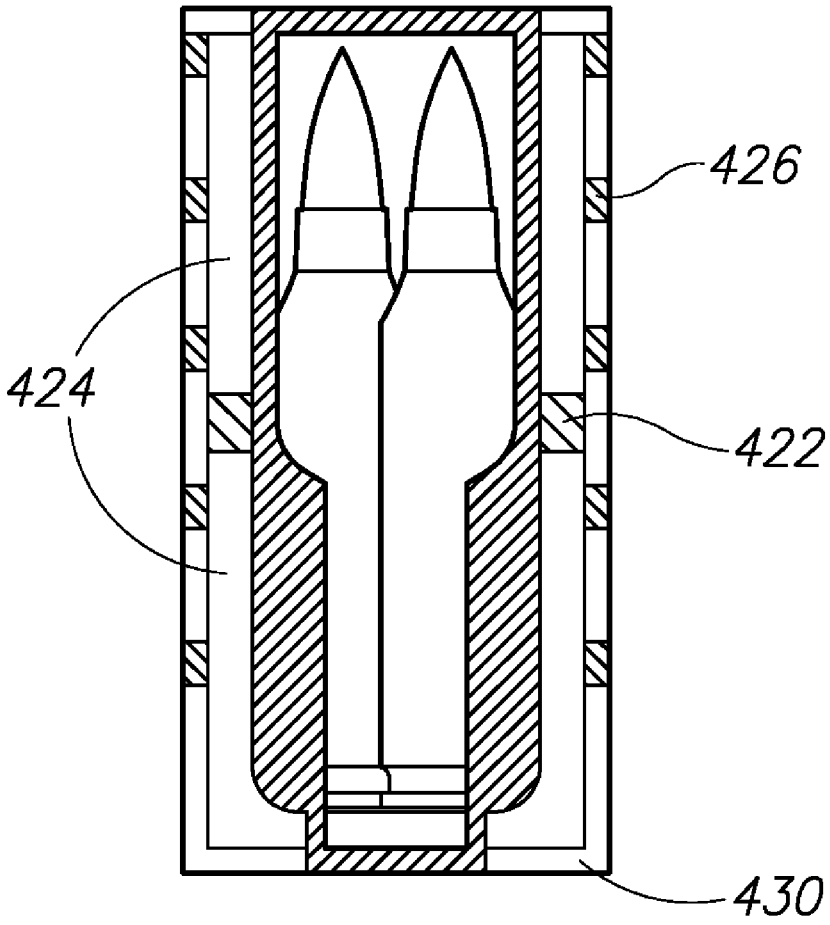
FIG. 18 is a top view of the ammunition magazine shown in FIG. 1A with the embodiment displayed in figure FIG. 17 attached.
Figure 19A:
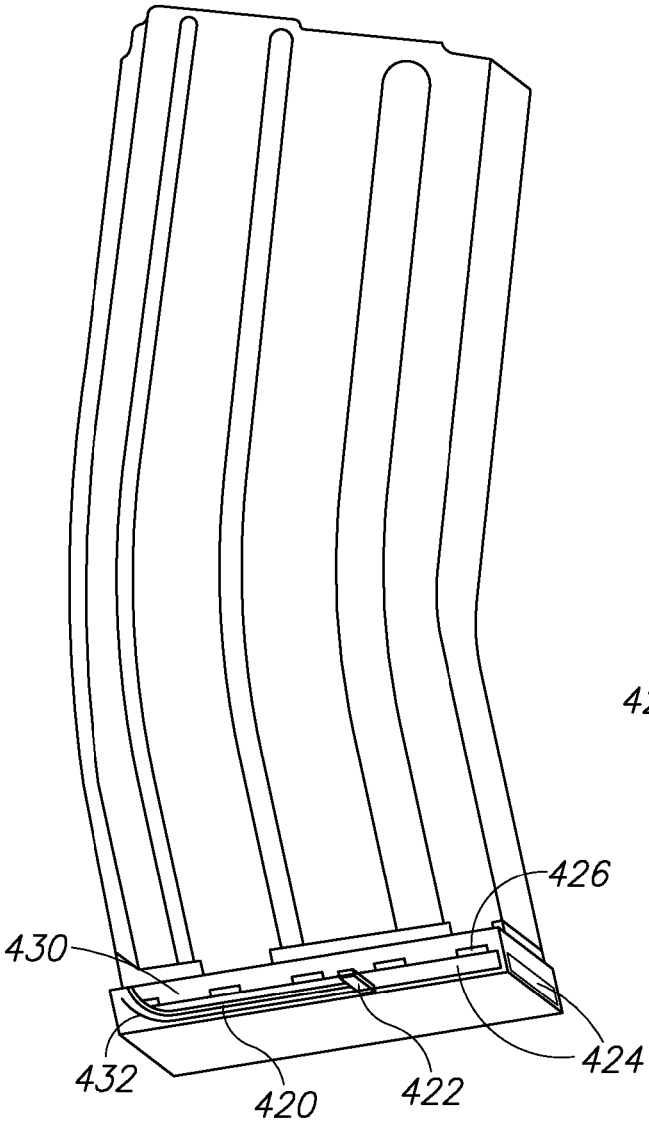
FIG. 19A is a side view of FIG. 18.
Figure 19B:
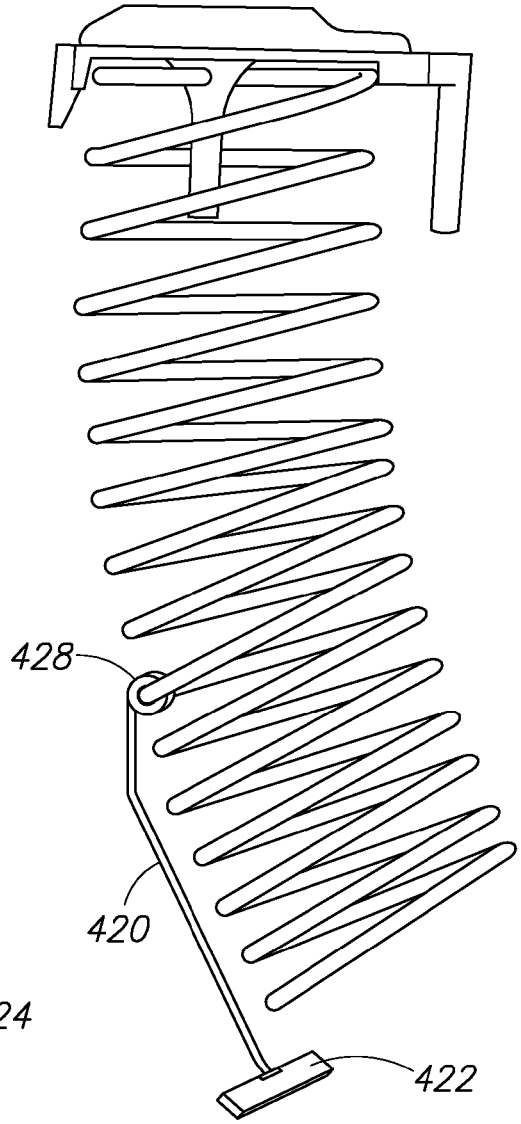
FIG. 19B is a breakdown of the embodiment displayed in FIG. 17, less the casing and display gauge, attached to the magazine spring in FIG. 1A.
Figure 20:
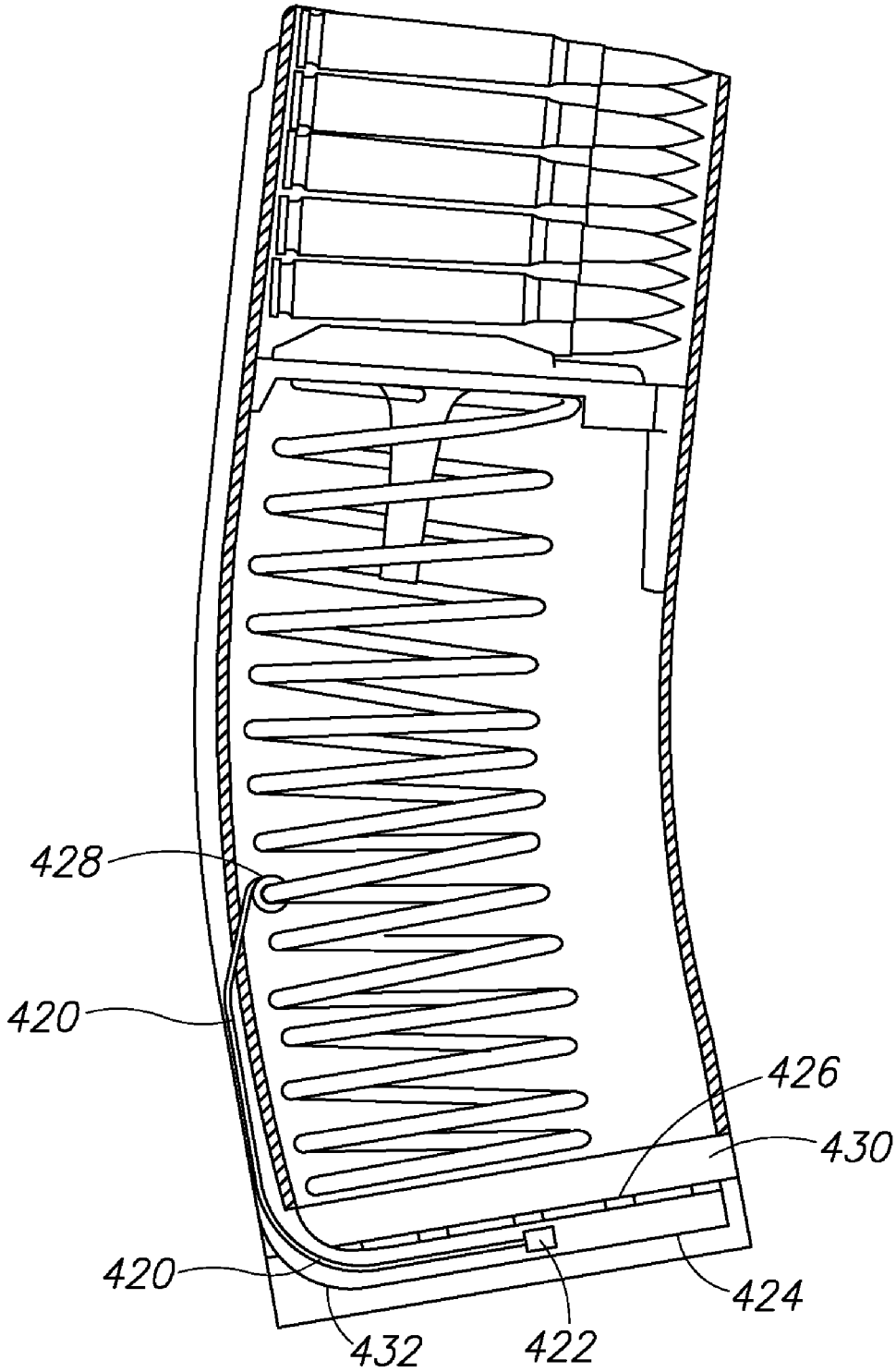
FIG. 20 is a side view in cross section of FIG. 19A.

FIGS. 14-16 show a round count slider in one embodiment. Sliding body 301 is attached to fixed body 302 by pegs 303 which hang on to the fixed body 302. These pegs are likewise tangent to the grooves 304 on the fixed body 302. The sliding body 301 is retracted by sliding it out along the path of the grooves 304. When the sliding body is slid out, indicator rod 322 likewise slides out by sliding out along the connector 305 connected to the strip 322.

As a magazine spring is compressed by the loading of the magazine with ammunition, a flexible material strip 320 connected to the spring by a ring 328 transfers the downward motion of the compressing magazine spring to the horizontal movement of an indicator rod 322 along a gauge 324 lined with measurement markers 326. The position of the indicator rod 322 in relation to the positions of the measurement markers 326, whose positionings are coordinated to known measures of ammunition based on the spring's compression level, communicates the level of ammunition remaining in the magazine to the operator of the magazine.

FIGS. 17-21 show a round count slider in one embodiment. As a magazine spring is compressed by the loading of the magazine with ammunition, a flexible material strip 420 connected to the spring by a ring 428 transfers the downward motion of the compressing magazine spring to the horizontal movement of an indicator rod 422 along a gauge 424 lined with measurement markers 426. The position of the indicator rod 422 in relation to the positions of the measurement markers 426, whose positionings are coordinated to known measures of ammunition based on the spring's compression level, communicates the level of ammunition remaining in the magazine to the operator of the magazine.

The round counter casing 430 is made of a clear or see-through (also opaque) material. (The angling of the top of the casing has no drastic effect on the better visibility of the indicator rod 422. A slope 432 aids in the translation of the vertical movement of indicator rod 422 to a horizontal movement by cutting down on the friction associated in the bending of the strip 422. This translation may be done without slope 432 because the material used in strip 420 is flexible enough to turn vertical movement into a horizontal one when it deflects off or bends against horizontal plane 434 through indicator rod 422. The vice versa is also true, as horizontal movement is translated into a vertical when the strip 420 through the indicator rod 422 is deflected off or bent off vertical plan 436.

While the preferred embodiment of the invention has been illustrated and described, as noted above, many changes can be made without departing from the spirit and scope of the invention. Accordingly, the scope of the invention is not limited by the disclosure of the preferred embodiment.

The embodiments of the invention in which an exclusive property or privilege is claimed are defined as follows:

1. A method for tracking a number of cartridges remaining within a magazine, comprising:

tracking a compression level of a magazine spring with an indicator strip coupled to at least one magazine spring spine of the magazine spring, the magazine spring housed within a magazine housing and coupled at a first end to a follower and at a second end to a foot plate, the magazine spring tangent to the foot plate;

selectively altering the number of cartridges in the magazine housing; and monitoring an indicator window attached to the foot plate and configured to guide the indicator strip, the indicator strip aligned with a reference on the indicator window showing the number of cartridges remaining based on the position of the at least one magazine spring spine coupled to the indicator strip and the compression level of the magazine spring.

2. The method of claim 1, wherein the indicator strip is coupled to the at least one magazine spring spine with a ring.

3. The method of claim 1, wherein the reference on the indicator window further comprises measurement markings.

4. The method of claim 3, wherein the measurement markings are coordinated based on known measures related to the magazine spring compression level.

5. The method of claim 1, wherein the reference on the indicator window is an electronic display.

6. The method of claim 1, wherein the reference on the indicator window further comprises a vibration warning.

7. The method of claim 1, wherein the indicator window is transparent.

8. A magazine configured for use in a firearm, the magazine comprising:

a floor plate;

a follower configured to support a cartridge;

a magazine spring coupled and tangent to the floor plate and the follower to cradle a cartridge for use in the firearm;

a round counter defining an aperture, coupled to the floor plate; and an indicator strip having a first end and a second end, the first end coupled to at least one magazine spring spine of the magazine spring, and the second end inserted into the aperture defined by the round counter, a indicator rod aligning with a reference on the round counter representing a number of cartridges remaining.

9. The system of claim 8, wherein the first end of the indicator strip is coupled to the at least one magazine spring spine with a ring.

10. The system of claim 8, wherein the reference on an indicator window farther comprises measurement markings.

11. The system of claim 10, wherein the measurement markings are coordinated based on known measures related to a magazine spring compression level.

12. The system of claim 8, wherein the reference on an indicator window is an electronic display.

13. The system of claim 8, wherein the reference on an indicator window farther comprises a vibration warning.

14. The system of claim 8, wherein an indicator window is transparent.

15. A round counter configured for use in a firearm magazine the round counter comprising:

a casing having a top and a bottom, the casing defining a channel with an aperture at the casing top;

an indicator strip having a first end and a second end, the first end coupled to at least one magazine spring spine of a magazine spring;

an indicator rod coupled to the second end of the indicator strip, the indicator rod slideably engaged with the channel; and an indicator window fixed to the top of the casing having a reference, the indicator rod viewable through the indicator window.

16. The round counter of claim 15, wherein the channel has a slope.

17. The round counter of claim 15, wherein the reference on the indicator window further comprises measurement markings.

18. The round counter of claim 17, wherein the measurement markings are coordinated based on known measures related to a magazine spring compression level.

19. The round counter of claim 15, wherein the reference on the indicator window is an electronic display.

20. The round counter of claim 15, wherein the reference on the indicator window further comprises a vibration warning wherein vibration is detectable by a user by touch.

* * * * *